US009351360B2

(12) United States Patent
Zhang

(10) Patent No.: US 9,351,360 B2
(45) Date of Patent: May 24, 2016

(54) DRIVE CIRCUIT FOR ILLUMINATION DEVICE AND ILLUMINATION DEVICE

(71) Applicant: OSRAM GmbH, Munich (DE)

(72) Inventor: Quan Zhang, Shenzhen (CN)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 14/826,231

(22) Filed: Aug. 14, 2015

(65) Prior Publication Data

US 2016/0050729 A1 Feb. 18, 2016

(30) Foreign Application Priority Data

Aug. 18, 2014 (CN) ..... 2014 1 0406563

(51) Int. Cl.
*H05B 33/08* (2006.01)

(52) U.S. Cl.
CPC ..... *H05B 33/0815* (2013.01)

(58) Field of Classification Search
None
See application file for complete search history.

(56) References Cited

U.S. PATENT DOCUMENTS

2002/0067623 A1* 6/2002 Balakrishnan ..... H02M 3/335 363/16
2010/0213857 A1* 8/2010 Fan ..... H05B 33/0827 315/186

* cited by examiner

*Primary Examiner* — Douglas W Owens
*Assistant Examiner* — Dedei K Hammond
(74) *Attorney, Agent, or Firm* — Viering, Jentschura & Partner mbB

(57) ABSTRACT

Various embodiments relate to a drive circuit for an illumination device and an illumination device. The drive circuit includes a first drive module, wherein the first drive module is configured to convert an alternating current signal from a power supply to a constant current drive signal supplied to a light-emitting unit of the illumination device, and wherein the drive circuit further includes a second drive module, and wherein the second drive module is in series connection with the first drive module and the light-emitting unit and is configured to hold a voltage which is applied across the second drive module by the constant current drive signal, and the second drive module further includes a first switch means which is driven by the held voltage to turn on such that a current signal output from the second drive module is a direct current signal.

12 Claims, 2 Drawing Sheets

DRIVE CIRCUIT FOR ILLUMINATION DEVICE AND ILLUMINATION DEVICE

CROSS-REFERENCE TO RELATED APPLICATION

This application claims priority to Chinese Patent Application Serial No. 201410406563.0, which was filed Aug. 18, 2014, and is incorporated herein by reference in its entirety.

TECHNICAL FIELD

Various embodiments generally relate to a drive circuit for an illumination device and an illumination device.

BACKGROUND

The single stage fly-back PFC (power factor correction) converter is usually used in the existing low-cost LED driver to convert the mains voltage to a DC current that an LED light-emitting module needs. However, the single stage fly-back PFC converter cannot be adapted to the change of the 50/60 Hz mains voltage in order to keep a proper power factor and THD (total harmonic distortion) performance. This makes the power conversion from the mains voltage to the LED module inconstant over time, causing the output current supplied to the LED module to include quite amount of ripple current.

The amplitude of the output ripple current depends on the output capacitance of the single stage fly-back PFC converter used and effective series resistance of the LED module. The frequency of the output ripple current is generally 100/120 Hz, double of the input voltage of the fly-back PFC converter. Besides, a phase lead may be present between the output ripple current and the mains voltage as the load characteristics of the LED module is resistive and capacitive. These problems often will lead to high ripple ratio (generally more than 35%), and thus cause low reliability and quality of the LED module, and flickering concerns in camera or video application as well.

The above-mentioned problems are usually solved in the prior art using a single stage fly-back converter or a double stage design with a considerable output capacitance. For the first type of prior art, if the effective series resistance of the LED module is 6 Ohm and the output capacitance of the fly-back is 500 μF, the resulting ripple ratio is 47%; when the output capacitance is doubled to 1000 μF, the resulting ripple ratio is 26%; and when the output capacitance is tripled to 1500 μF, the resulting ripple ratio is 17%. However, this solution becomes quite unfavorable when the effective series resistance of the LED module is less and less. Besides, more capacitance requires more receiving space of PCB and bigger housing, moreover, the increased capacitance may lead to the problems such as power up delay and short circuiting current on the circuit.

In a second solution of the prior art, the combination of either a boost PFC module plus a fly-back module or a fly-back PFC module plus a buck module is often used, in which the first stage will provide a good power factor, THD, and a stable DC bus voltage, while the second stage will convert the bus voltage to a DC current and supply it to the LED module. Although no ripple current is at the LED driver output in this solution, compared with the low-cost single stage design, the double stage design has a relatively high cost and does not have a compact structure. Furthermore, the double stages design has an efficiency lower than that of the single stage design in the actual application, and is also subjected to EMI problem.

SUMMARY

Various embodiments provide a driver for an illumination device, especially a driver for an illumination device using an LED as a light source, and an illumination device including the driver. The driver according to various embodiments may effectively reduce or avoid the ripple current of a light-emitting unit of the illumination device.

Besides, the driver according to various embodiments has a smaller number of constituent parts, a low cost, and a compact structure, moreover, this driver has good compatibility and is capable of working together with any constant current LED drivers with ripple current, regardless whether the constant current drivers are of control loop type, PSR, or opto-coupler regulated. The interface of the driver according to various embodiments is also simple with positive and negative terminals, and can be used as a standalone product.

A drive circuit may include a first drive module, wherein the first drive module is configured to convert an alternating current signal from a power supply to a constant current drive signal supplied to a light-emitting unit of the illumination device, and wherein the drive circuit further includes a second drive module, and wherein the second drive module is in series connection with the first drive module and the light-emitting unit and is configured to hold a voltage which is applied across the second drive module by the constant current drive signal, and the second drive module further includes a first switch means which is driven by the held voltage to turn on such that a current signal output from the second drive module is a direct current signal.

The second drive module of the drive circuit according to various embodiments may sample and hold a peak value of the voltage sustained by the whole drive circuit, wherein the sustained voltage is often superimposition of a direct current component and an alternating current component. The second drive module of the drive circuit is driven by a constant voltage obtained according to the held voltage so as to conduct direct current, therefore, the second drive module presents a low impedance characteristic to the direct current but a high impedance characteristic to the alternating current, that is, it ensures that the current passing through the second drive module is a direct current, and the drive circuit thereby can reduce the ripple current.

According to various embodiments, the second drive module further includes a voltage hold unit for sampling the constant current drive signal and holding a voltage which is applied across the second drive module by the constant current drive signal, and an execution unit which is configured such that in a response to the held voltage, a current signal output from the second drive module is a direct current signal. When the second drive module is connected with for instance a constant current driver for an LED, the voltage hold unit of the second drive module may sample and hold the voltage applied thereon, in this way, the voltage hold unit may supply a constant voltage to the execution unit to drive and control the execution for example in a manner of constant current, so that the execution unit outputs a direct current.

In various embodiments, the drive circuit further includes an auxiliary hold unit for holding a voltage together with the voltage hold unit wherein the voltage is applied across the second drive module by the constant current drive signal. The auxiliary hold unit helps the voltage hold unit in holding the voltage sampled by the voltage hold unit, which effectively improves the stability of the drive circuit.

In various embodiments, the drive circuit further includes a current-limiting unit for controlling a maximum current flowing through the second drive module. The current-limiting unit may control the maximum allowable current of the second drive module to protect the second drive module against damage due to over-current in cases where short-circuiting of LED load occurs.

In various embodiments, the voltage hold unit includes a capacitor for supplying a constant drive voltage to the execution unit. The voltage of the capacitor is at a constant value so as to supply a constant drive current to the first switch means such that the first switch means may output a direct current. Besides, during the maximum voltage dumping of the drive circuit, the capacitor is charged, accordingly, the second drive module of the drive circuit according to various embodiments is not another current controller apart from the first drive module, but a voltage controller. With the help of the direct current voltage on the capacitor, the second drive module only allows flowing direct current.

The auxiliary hold unit may include a second switch means which is configured to constitute a Darlington stage with the first switch means. The Darlington consisting of the first switch means and the second switch means can minimize the consumption of the capacitor, and the capacitor is fully charged to supply a drive electric energy to the Darlington for bearing the LED current.

The first switch means and the second switch means are configured as bipolar transistors or MOSFETs.

The voltage hold unit further includes a first diode and a second diode, wherein the cathode of the first diode is connected to the cathode of the second diode, and the anode of the second diode is connected to the capacitor. A sum of voltages across the first diode, the second diode, and the capacitor defines a peak value of a voltage across the second drive module of the drive circuit according to various embodiments.

The auxiliary hold unit may include a first transistor, a first resistor having one end connected to the control electrode of the first transistor, and a second resistor connected to the reference electrode of the first transistor, wherein the other end of the first resistor is connected to a node between the second diode and the capacitor. Since the voltage of the capacitor is constant, the output current of the first transistor may be a constant current.

The execution unit may include a second transistor, a third resistor connected between the control electrode of the second transistor and the reference electrode of the first transistor, and a fourth resistor connected to the reference electrode of the second transistor. Since the output current of the first transistor is constant, the current driving the second transistor is also constant, therefore, the current output from the second transistor also may be a constant current, whereby the current conducted by the second drive module of the drive circuit according to various embodiments is a direct current.

The current-limiting unit may include a third transistor and a fifth resistor, wherein the fifth resistor is connected between the control electrode of the third transistor and the reference electrode of the second transistor, and operating electrode of the third transistor is connected to a node between the control electrode of the first transistor and the first resistor.

Various embodiments also provide an illumination device including a light-emitting unit and the drive circuit as described above connected to the light-emitting unit. The illumination device according to various embodiments has the drive circuit with a low cost and a simple structure, and can effectively reduce or avoid the ripple current of the light-emitting unit.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Figure 1:
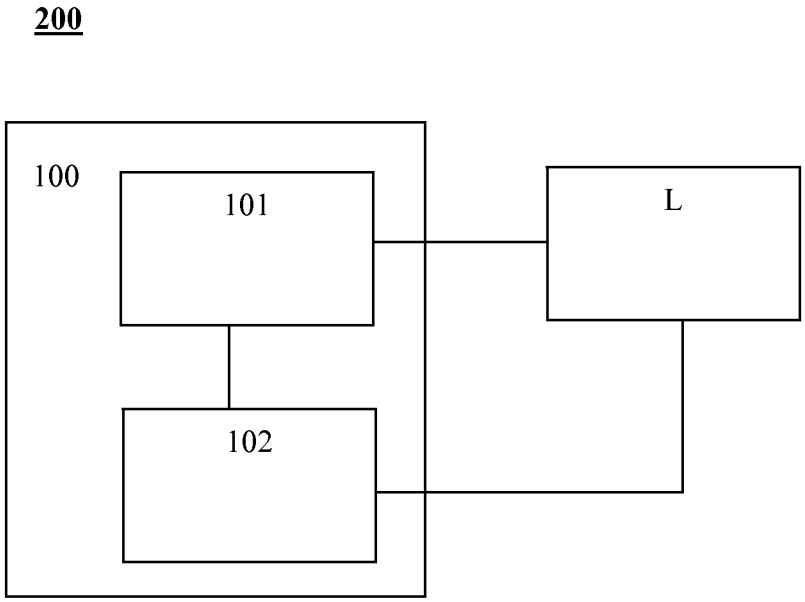
FIG. 1 shows a schematic functional block diagram of an illumination device according to the present disclosure.

FIG. 1 shows a schematic functional block diagram of an illumination device 200 according to various embodiments. The illumination device 200 according to various embodiments especially includes a light-emitting unit L configured as LED, and a drive circuit 100. The drive circuit 100 particularly includes a first drive module 101 supplying a constant current to the light-emitting unit L of the illumination device 200, wherein the first drive module 101 may be implemented as a constant current LED driver supplying a constant current to the LED. This constant current LED driver can convert an alternating current signal from a power supply to a constant drive signal for output.

Besides, this drive circuit 100 further includes a second drive module 102. This drive module 102 is in series connection with the light-emitting unit L and the first drive module 101, and is further configured to sample a voltage applied by the constant current drive signal on the second drive module 102 and is capable of holding this voltage so as to output a DC current when being driven by the held voltage, thus achieving the object of reducing or avoiding the ripple current of the light-emitting unit L.

Figure 2:
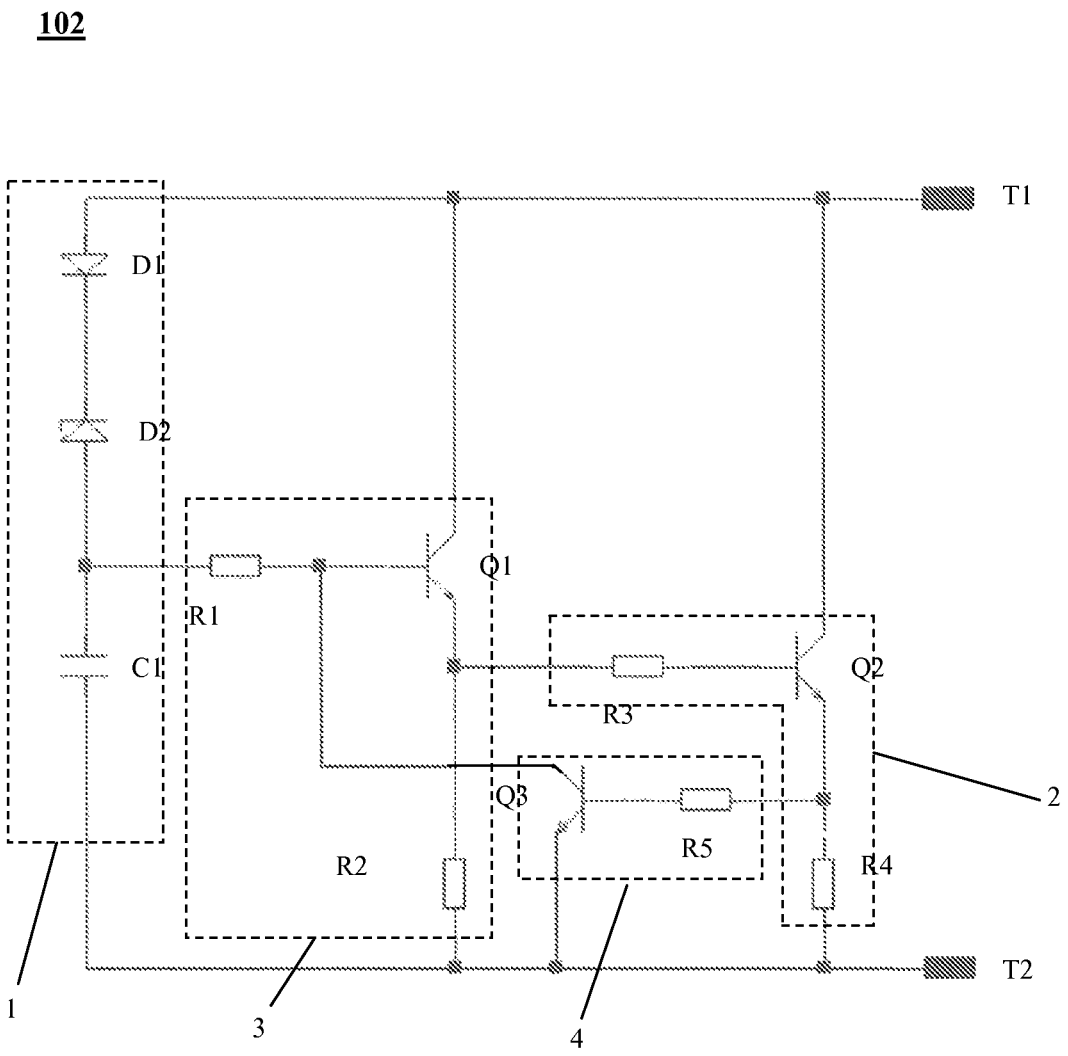
FIG. 2 shows a schematic diagram of a circuit structure of a second drive module of a drive circuit according to the present disclosure.

FIG. 2 shows a schematic diagram of a circuit structure of the second drive module 102 of the drive circuit 100 according to various embodiments. The second drive module 102 according to various embodiments has interfaces for connection with the first drive module 101 and the light-emitting unit L. The second drive module 102 is connected with the light-emitting unit L and the first drive module 101 via two terminals, i.e., first terminal T1 and second terminal T2, respectively, so as to be inserted and connected between the first drive module 101 and the light-emitting unit L. The first terminal T1 and the second terminal T2 may be a positive electrode and a negative electrode, respectively, that is, they can indicate the direction of a current flowing from the light-emitting unit L to the second drive module 102. The second drive module 102 especially mainly includes four units which are a voltage hold unit 1, an execution unit 2, an auxiliary hold unit 3, and a current-limiting unit 4.

Specifically, the voltage hold unit 1 includes a first diode D1 and a second diode D2, and a capacitor C1. The first diode D1 may be a common bipolar diode, and the second diode D2 is a zener diode, alternatively, the first diode D1 is configured as a zener diode and the second diode D2 is configured as a common bipolar diode. The first diode D1 and the second diode D2 form a clamping circuit or a bi-directional zener diode, i.e., TVS diode, which is capable of holding a voltage applied on the second drive module 102, which voltage is specifically limited by respective conduction voltages of the first diode D1 and the second diode D2. However, the person skilled in the art would know that other circuit structures which have the same or similar function can substitute the circuit structure implemented here. The charged capacitor C1 has a constant voltage so as to be capable of supplying a constant drive current to the auxiliary hold unit 3 downstream of the voltage hold unit 1, the first transistor Q1 of the auxiliary hold unit 3 thereby can output a constant current.

The auxiliary hold unit 3 located downstream of the voltage hold unit 1 includes a first resistor R1, a first transistor Q1, and a second resistor R2, wherein the first resistor R1 and the second resistor R2 are connected to a control electrode and a reference electrode of the first transistor Q1, respectively. In various embodiments, the first transistor Q1 is implemented as a first bipolar transistor such that the first bipolar transistor has a base and an emitter connected with the first resistor R1 and the second resistor R2, respectively. The second resistor R2 is arranged for preventing disappearance of the turn-on current of the first transistor Q1 in some particular situations so as to improve the stability. In this way, when driven by the constant voltage of the capacitor C1, given that the changes in the base-emitter voltage of the first transistor Q1 in the circuit is omitted, the base-emitter current of the first transistor Q1 is constant, which then results that the collector-emitter current of the first transistor Q1 is also constant.

The execution unit 2 of the second drive module 102 includes a second transistor Q2 which is also configured as a bipolar transistor, and a third resistor R3 and a fourth resistor R4 which are connected to a control electrode and a reference electrode of the second transistor Q2, respectively. In cases where the second transistor Q2 is configured as a second bipolar transistor, a base of the second bipolar transistor is connected to the reference electrode of the first transistor Q1, i.e., an emitter of the first bipolar transistor, via the third resistor R3. The first transistor Q1 and the second transistor Q2 form a Darlington stage. Since the current at the collector emitter of the first bipolar transistor is constant as mentioned above, the current at the base emitter of the second bipolar transistor is also constant, thus, the current at the collector emitter of the second bipolar transistor is also constant. According to such an example, in cases where the capacitor C1 provides a constant voltage, the second transistor Q2 in the execution unit 2 can output a DC current.

The current-limiting unit 4 is configured to control a maximum allowable current of the second drive module 102. The current-limiting unit 4 includes a third transistor Q3 and a fifth resistor R5, wherein the third transistor Q3 preferably is configured as a third bipolar transistor which has a collector connected to the base of the first bipolar transistor and a base connected to an emitter of the second bipolar transistor via the fifth resistor R5. In this way, the current-limiting unit 4 can confine the current in the second drive module and is protected against damage due to over-current in cases where short-circuiting occurs to an LED load connected thereto. Besides, in some particular situations, the current-limiting unit 4 according to various embodiments also can be used in the hot-plug-in application since it can confine or prevent the damage cause by over-current.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

What is claimed is:

1. A drive circuit for an illumination device, comprising:

a first drive module configured to convert an alternating current signal from a power supply to a constant current drive signal supplied to a light-emitting unit of the illumination device, and a second drive module connected in series with the first drive module and the light-emitting unit, and configured to hold a voltage which is applied across the second drive module by the constant current drive signal, the second drive module comprising a first switch which is driven by the held voltage to turn on such that a current signal output from the second drive module is a direct current signal.

2. The drive circuit according to claim 1, wherein the second drive module further comprises a voltage hold unit for sampling the constant current drive signal and holding a voltage which is applied across the second drive module by the constant current drive signal, and an execution unit which is configured such that in a response to the held voltage, a current signal output from the second drive module is a direct current signal.

3. The drive circuit according to claim 2, wherein the drive circuit further comprises an auxiliary hold unit for holding a voltage together with the voltage hold unit wherein the voltage is applied across the second drive module by the constant current drive signal.

4. The drive circuit according to claim 2, wherein the drive circuit further comprises a current-limiting unit for controlling a maximum current flowing through the second drive module.

5. The drive circuit according to claim 2, wherein the voltage hold unit comprises a capacitor for supplying a constant drive voltage to the execution unit.

6. The drive circuit according to claim 3, wherein the auxiliary hold unit comprises a second switch which is configured to constitute a Darlington stage with the first switch means.

7. The drive circuit according to claim 6, wherein the first switch and the second switch are configured as bipolar transistors or MOSFETs.

8. The drive circuit according to claim 6, wherein the voltage hold unit further comprises a first diode and a second diode, wherein the cathode of the first diode is connected to the cathode of the second diode, and the anode the second diode is connected to the capacitor.

9. The drive circuit according to claim 8, wherein the auxiliary hold unit comprises a first transistor, a first resistor having one end connected to the control electrode of the first transistor, and a second resistor connected to the reference electrode of the first transistor, wherein the other end of the first resistor is connected to a node between the second diode and the capacitor.

10. The drive circuit according to claim 9, wherein the execution unit comprises a second transistor, a third resistor connected between the control electrode of the second transistor and the reference electrode of the first transistor, and a fourth resistor connected to the reference electrode of the second transistor.

11. The drive circuit according to claim 10, wherein the current-limiting unit comprises a third transistor and a fifth resistor, wherein the fifth resistor is connected between the control electrode of the third transistor and the reference electrode of the second transistor, and the operating electrode the third transistor is connected to a node between the control electrode of the first transistor and the first resistor.

12. An illumination device, comprising a light-emitting unit and a drive circuit connected to the light-emitting unit, the drive circuit comprising: a first drive module configured to convert an alternating current signal from a power supply to a constant current drive signal supplied to a light-emitting unit of the illumination device, and a second drive module connected in series with the first drive module and the light-emitting unit, and configured to hold a voltage which is applied across the second drive module by the constant current drive signal, the second drive module comprising a first switch which is driven by the held voltage to turn on such that a current signal output from the second drive module is a direct current signal.

* * * * *